United States Patent [19]

Shindo et al.

[11] Patent Number: 5,049,447

[45] Date of Patent: Sep. 17, 1991

[54] POLYESTER FIBER FOR INDUSTRIAL USE AND PROCESS FOR PREPARATION THEREOF

[75] Inventors: Takeshi Shindo, Okazaki; Masuki Sano, Anjo; Ken-ichiro Oka, Okazaki, all of Japan

[73] Assignee: Toray Industries, Inc., Japan

[21] Appl. No.: 346,472

[22] Filed: May 2, 1989

[30] Foreign Application Priority Data

May 9, 1988 [JP] Japan ..... 63-111829

[51] Int. Cl.[5] ..... D02G 3/00

[52] U.S. Cl. ..... 428/373; 57/243; 57/250; 57/251; 57/902; 428/364; 428/375; 428/395

[58] Field of Search ..... 428/364, 373, 395, 375; 528/301, 308, 308.1; 57/243, 250, 251, 902

[56] References Cited

U.S. PATENT DOCUMENTS 4,101,525 7/1978 Davis et al. ..... 528/308.2
4,414,169 11/1983 McClary .
4,690,866 9/1987 Kumakawa et al. ..... 428/364

FOREIGN PATENT DOCUMENTS 0169415 1/1986 European Pat. Off. .
0295147 12/1988 European Pat. Off. ..... 528/308.2

*Primary Examiner*—Lorraine T. Kendell
*Attorney, Agent, or Firm*—Austin R. Miller

[57] ABSTRACT

Disclosed is a polyethylene terephthalate untwisted multifilament which satisfies the following requirements (A), (B), (C) and (D);

(A) the intrinsic viscosity [IV] is 0.97 to 1.15;

(B) the amorphous orientation function [fa] is not larger than 0.55;

(C) the tenacity [T] (g/d), the shrinkage [ΔS] (%) as measured after standing in dry air at 150° C. for 30 minutes, the medium elongation [ME] (%) under a load of 4.5 g/d, and the dimensional stability index [Y] expressed by the formula: $Y = -ME^{0.81} + \Delta S + 1.32$ are within ranges defined by the following formulae (a), (b), (c), (d) and (e):

$$0.33Y + 5.55 \leqq T \leqq 0.33Y + 6.50 \quad \text{(a)},$$

$$8.0 \leqq T \leqq 9.5 \quad \text{(b)},$$

$$8.5 \leqq Y \leqq 10.5 \quad \text{(c)},$$

$$5 \leqq ME \leqq 10 \quad \text{(d)},$$

and $$2 \leqq \Delta S \leqq g \quad \text{(e)};$$

and (d) the elongation at break is at least 11% and the product of the tenacity and elongation, which is defined by:

$$[\text{tenacity } (g/d) \text{ at break}] \times \sqrt{\text{elongation } (\%) \text{ at break}},$$

is 30 to 36.

2 Claims, No Drawings

POLYESTER FIBER FOR INDUSTRIAL USE AND PROCESS FOR PREPARATION THEREOF

BACKGROUND OF THE INVENTION (1) Field of the Invention

The present invention relates to a polyester fiber suitable for use mainly in the production of industrial materials such as tire cords, V-belts, conveyor belts and hoses, and to a process for the preparation of this polyester fiber. More particularly, the present invention relates to a polyester fiber having an excellent dimensional stability, an enhanced toughness, and a latent high-tenacity performance, i.e., a final treated and processed product of which, for example, a treated cord or a cured cord to be used as a reinforcer for a rubber structure, has a high tenacity, a low shrinkage, a high modulus and a high chemical stability and therefore is useful as industrial materials, and to a process for the preparation of this polyester fiber.

(2) Description of the Related Art

A polyester fiber, especially a polyethylene terephthalate fiber, has well balanced and high tenacity, modulus and dimensional stability (low shrinkage), and is widely used as a reinforcer for a rubber structure such as a tire, a V-belt or a conveyor belt. Recently, the field of application of the polyester fiber has been broadened, and to be able to use the polyester fiber as a reinforcer instead of the "rayon" used as a carcass material of a radial tire and as a substitute for "Vinylon" used in the field of industrial materials, the polyester fiber must have a higher modulus, a lower shrinkage and a higher fatigue resistance. Processes for the preparation of polyethylene terephthalate fibers excellent in these characteristics are disclosed, for example, in Japanese Unexamined Patent Publication No, 53-58031, Japanese Unexamined Patent Publication No. 57-154410, Japanese Unexamined Patent Publication No. 57-154411, Japanese Unexamined Patent Publication No. 57-161119, Japanese Unexamined Patent Publication No. 58-46117, Japanese Unexamined Patent Publication No. 58-115117, Japanese Unexamined Patent Publication No. 58-186607, Japanese Unexamined Patent Publication No. 58-23914 and Japanese Unexamined Patent Publication No. 58-116414.

According to these known processes, polyethylene terephthalate is melt-spun, the as-spun filament yarn is taken up at a relatively high spinning speed of 1,000 to 3,000 m/min under a high tension to obtain a highly oriented undrawn filament yarn having a birefringence of 0.02 to 0.07, that is, POY, and this POY is heat-drawn at a low draw ratio of 1.5 to 3.5.

The polyester fibers according to the processes as described above (hereinafter referred to as "POY/DY") have high modulus and low shrinkage as compared with the conventional high-tenacity fiber, that is, a high-tenacity fiber (hereinafter referred to as "UY/DY") obtained by taking up a melt-spun filament yarn at a low spinning speed of less than 1,000 m/min under a low tension to obtain a lowly oriented undrawn filament yarn having a birefringence not larger than 0.01 and heat-drawing the lowly oriented undrawn filament yarn at a high draw ratio of 4 to 7. For example, if this polyester fiber is used as a carcass material of a radial tire, tire performances such as the driving stability at a high speed and the comfort when driving are improved and the percentage of defective tires is reduced, and therefore, the polyester fiber makes a great contribution to an improvement of the productivity.

Nevertheless, the polyester POY/DY having such excellent characteristics has some problems as described below. First, the tenacity and elongation at break are obviously lower than those of polyester UY/DY. The present inventors found that if the elongation at break of the fiber is low, the tenacity is extremely reduced during the twisting step or the dipping treatment and the cord made therefrom has an undesirably low tenacity, and that if the tenacity of the fiber is low, when the fiber is used as a reinforcer for a rubber structure such as a tire or a V-belt, the fatigue resistance is low and this low fatigue resistance causes a serious practical problem. If the amount of the reinforcing fiber is increased to obtain a high tenacity of the rubber structure, the cost is increased and the high-speed performance is reduced by the increase in weight. This is serious particularly in the case of a large tire.

The polyester filament yarn proposed in Japanese Unexamined Patent Publication No. 53-58031 has a relatively high tenacity of 7.3 to 9.1 g/d as disclosed in the examples of this patent publication, but since the elongation at break is very low, i.e., 6.7 to 8.3%, the tenacity is greatly reduced during the twisting step and the reduction of the tenacity is extreme upon application of an adhesive, and when subjected to the heat setting treatment and dipping treatment. Accordingly, the tenacity of the obtained treated cord is lower than 6 g/d, and to be able to use this cord as a reinforcing cord for a rubber structure, a further improvement of the tenacity is required.

In the process for the preparation of this polyester filament yarn, the as-spun filament yarn is quenched in a gas atmosphere maintained at a temperature lower than 85° C. just below the spinneret under a condition wherein the spinning speed is relatively high. A known method of drawing industrial polyester filament yarns is adopted for the drawing, and therefore, to increase the modulus of the drawn filament yarn, the POY is drawn until almost broken, and a problem of frequent yarn breakages or filament breakage arises.

In Japanese Unexamined Patent Publication No. 57-154410 and Japanese Unexamined Patent Publication No. 57-154111, as the means for solving the foregoing problems, the applicant proposed the process in which a high-temperature atmosphere is maintained just below the spinneret and the terminal modulus of the obtained polyester filament yarn (hereinafter referred to as "raw yarn") is controlled to a level lower than 15 g/d.

In the process disclosed in Japanese Unexamined Patent Publication No. 57-161119 and Japanese Unexamined Patent Publication No. 58-46117, the toughness of the raw yarn and cord made therefrom is considerably increased, but the tenacity of the treated cord is 6.6 g/d at highest.

When the draw ratio is merely increased to obtain a high tenacity of the raw yarn, the elongation at break of the obtained high-tenacity raw yarn becomes lower than 10%, and when a greige cord is formed by twisting the raw yarn and a treated cord is obtained by subjecting the greige cord to the dipping treatment, a special means is not adopted for moderating the reduction of the tenacity, and hence, it is impossible to obtain a product in which the requirements of high tenacity and high fatigue resistance are both satisfied.

In the process proposed in Japanese Unexamined Patent Publication No. 58-115117, it is intended to increase the tenacity of the raw yarn and cord made therefrom by heat-drawing POY composed of a polyester having a high degree of polymerization. However, since a high dimensional stability must be simultaneously obtained, the level of the tenacity in the obtained treated cord is inevitably lower than that in conventional UY/DY.

In the process proposed in Japanese Unexamined Patent Publication No. 59-116414, since the heat drawing is carried out at a relatively low temperature, the drawing tension is increased and the maximum permissible draw ratio is reduced. Further, since a condition resulting in a low relax ratio is adopted, a raw yarn having a high tenacity and a high elongation at breakage cannot be obtained. Furthermore, the tenacity retention ration is very low and the tenacity is about 6.3 g/d which is approximately the same level as that of conventional POY/DY.

SUMMARY OF THE INVENTION

A primary object of the present invention is to provide a polyester fiber having an excellent dimensional stability and a high tenacity performance, which is suitable for industrial use.

A second object of the present invention is to provide a polyester fiber for industrial use, which has an excellent dimensional stability, a high tenacity and a high durability and is suitable as a reinforcer for a rubber structure, especially a tire cord.

A third object of the present invention is to provide a polyester fiber which has a much higher tenacity than that of a conventional high-tenacity fiber obtained by heat-drawing a highly oriented undrawn filament yarn, has a treated cord tenacity comparable to or higher than that of a conventional high-tenacity fiber obtained by heat-drawing a lowly oriented undrawn filament yarn, and has a greatly improved dimensional stability compared to these conventional high-tenacity fibers.

A fourth object of the present invention is to provide a high-durability polyester fiber, in which the dimensional stability of a treated cord prepared from this polyester fiber is excellent, that is , the treated cord has a low shrinkage such that the dimensional stability index [ME+ΔS] of the treated cord (the dimensional stability index of the treated cord is different from that of the raw yarn and is expressed by [ME+ΔS] wherein ME stands for the medium elongation, i.e., the elongation under a load of 4.5 g/d and ΔS stands for the shrinkage as measured after standing in hot and dry air at 150° C. for 30 minutes) is lower than 8.8%, and the chemical stability, especially the resistance to hydrolysis of the polyester fiber in a rubber is much higher than that of a conventional high-tenacity fiber obtained by heat-drawing a highly oriented undrawn yarn POY.

A fifth object of the present invention is to provide a polyester fiber having a high tenacity retention ratio, a high tenacity and a high durability.

A sixth object of the present invention is to provide a process for the preparation of polyester fibers for industrial use, in which the foregoing primary through fifth objects can be obtained.

In one aspect of the present invention, there is provided a polyester fiber for industrial use, characterized in that at least 90 mole % of total recurring units of the molecule chain are composed of polyethylene terephthalate, and the fiber simultaneously satisfies all of the following requirements (A), (B), (C), (D) and (E):

(A) the intrinsic viscosity [IV] is 0.97 to 1.15;

(B) the amorphous orientation function [fa] is not larger than 0.55;

(C) the tenacity [T] (g/d), the shrinkage [ΔS](%) as measured after standing in dry air at 150° C. for 30 minutes, the medium elongation [ME](%) under a load of 4.5 g/d, and the dimensional stability index [Y] expressed by the formula: $Y=-ME^{0.81}+\Delta S+1.32$ are within ranges defined by the following formulae (a), (b), (c), (d) and (e):

$$0.33Y+5.55 \leqq T \leqq 0.33Y+6.50 \quad \text{(a)},$$

$$8.0 \leqq T < 9.5 \quad \text{(b)},$$

$$8.5 \leqq Y \leqq 10.5 \quad \text{(c)},$$

$$5 \leqq ME \leqq 10 \quad \text{(d)},$$

and $$2 \leqq \Delta S \leqq 6 \quad \text{(e)};$$

(D) the elongation at break is at least 11% and the product of the tenacity and elongation, which is defined by:

$$[\text{tenacity } (g/d) \text{ at break}] \times \sqrt{\text{elongation (\%) at break}},$$

is 30 to 36; and (E) the fiber is composed substantially of untwisted multifilaments.

In another aspect of the present invention, there is provided a process for the preparation of polyester fibers for industrial use, which comprises the steps of:

(1) shaping a polyester into chips, in which 90% by mole of total recurring units in the molecule chain of the polyester are composed of polyethylene terephthalate, and said polyester has a high degree of purity such that particles of the incorporated substances including additives contained therein have a diameter of 1 to 10 μm and the content of said particles is not larger than 200 ppm; and subjecting the chips to a solid phase polymerization to obtain chips which has an intrinsic viscosity [IV] of 1.25 to 1.8 and in which the amount of broken chip pieces produced during the solid phase polymerization and having a volume not larger than 65% of the volume of the shaped chips is not larger than 500 ppm based on the weight of the entire chips;

(2) melting the polyester chips and spinning the molten polyester from a spinneret having up to 3 lines of extrusion orifices arranged annularly, to form a filament yarn;

(3) passing the as-spun filament yarn, immediately without rapid quenching through a high-temperature atmosphere maintained at 205° to 350° C. and having a length of 100 to 300 mm just below the spinneret, to effect slow cooling;

(4) introducing the slowly cooled spun filament yarn into a cooling chimney having a length of at least 100 mm and blowing a gas maintained at 50° to 120° C. to the periphery of the spun filament yarn at a speed of 15 to 50 m/min;

(5) introducing the spun filament yarn, which has passed through the cooling chimney, into a first spinning duct where the spun filament yarn is further cooled while a part of the associated gas present around and among the spun filament yarn is expelled, and introducing the spun filament yarn into a second spinning duct, below which an exhaust device is arranged, where the spun filament yarn is further cooled while a part of the associated gas is expelled and disturbance of the gas current in the second spinning duct is prevented, to completely solidify the spun filament yarn;

(6) wrapping the completely solidified spun filament yarn on a take-off roll rotating at a high speed of 1,500 to 2,600 m/min, so that the birefringence of the spun filament yarn after the passage through the take-off roll is 0.025 to 0.060;

(7) delivering the spun filament yarn, which is wrapped on the take-off roll, to a multi-stage drawing zone directly without being wound on a take-up roll, where the spun filament yarn is drawn in a multi-stage at a total draw ratio of 2.2 to 2.65 and at a draw ratio in the first drawing stage of 1.45 to 2.00, and simultaneously, subjected to an entangling treatment by applying a fluid midway in the drawing while the spun filament yarn is drawn, to obtain a drawn filament yarn; and (8) subjecting the drawn filament yarn coming from a final drawing roll arranged in the drawing zone to a relaxing treatment at a relax ratio of 4 to 10% while subjecting the drawn filament yarn to the entangling treatment, wrapping the drawn fiber on a relaxing roll not heated or heated at a temperature lower than 130° C., and then winding the drawn filament yarn at a speed of 3,500 to 5,500 m/min on a take-up roll.

DESCRIPTION OF THE PREFERRED EMBODIMENTS

Due to the above-mentioned filament yarn properties (A) through (E), the polyester fiber of the present invention is greatly improved compared to conventional polyester fibers in that, when the polyester fiber is used as a reinforcer for a rubber structure, the tenacity, elongation, dimensional stability, toughness, fatigue resistance and in-rubber heat resistance are increased in the treated cord, and a reinforcer for a rubber structure, in which the foregoing characteristics are well balanced, can be obtained.

If the above-mentioned requirements for the polyester fiber of the present invention, especially the requirements (A), (B), (C)-(a), (C)-(d) and (C)-(e), are satisfied, a treated cord having a dimensional stability index of 7.0 to 8.8% is obtained.

If all of the above-mentioned requirements (A), (B), (C), (D) and (E) are satisfied, when the polyester fiber of the present invention is twisted to form a greige cord and when an adhesive is applied to this greige cord and heat setting is carried out to form a treated cord, reduction of the tenacity is greatly alleviated, and a treated cord having a tenacity of at least 6.7 g/d and an elongation of at least 12%, that is, a high-toughness treated cord, can be obtained.

Furthermore, by satisfying the above-mentioned requirements (A), (B), (C) and (D), a treated cord having an excellent fatigue resistance in a rubber can be obtained.

Moreover, if the above-mentioned requirements (B), (C)-(b), (C)-(c), (C)-(d) and (C)-(d) are satisfied, a treated cord having an excellent heat resistance in a vulcanized rubber can be obtained.

If the above-mentioned requirements (A), (B), (C), and (D) are satisfied and the dry hot shrinkage [ΔS](%) as measured after standing in dry air at 150 ° C. for 30 minutes satisfies the condition of $2 \leqq \Delta S \leqq 4.5$, a treated cord having an excellent fatigue resistance and in-rubber heat resistance can be obtained.

Of particular importance is that if among the foregoing yarn properties, the dimensional stability is controlled to 8.5 to 1.5, the dimensional change can be controlled to a very low level due to the synergistic effects of this dimensional stability index with other structural requirements when the polyester fiber of the present invention is twisted to form a greige cord, an adhesive is applied to the greige cord, and heat setting is carried out to form a treated cord.

As apparent from the foregoing description, if the foregoing requirements are satisfied, a reduction of each characteristic can be controlled to a very low level due to mutual actions of the respective requirements when a greige cord is formed by twisting the filament yarn and a treated cord is formed by applying an adhesive to the greige cord and carrying out heat setting, and a treated cord having excellent characteristics as the rubber reinforcer can be obtained.

The respective properties of the polyester fiber of the present invention and the methods of measuring these properties will now be described.

(1) Intrinsic Viscosity (IV)

The relative viscosity ($\eta r$) of a solution of 8 g of a polymer sample in 100 ml of o-chlorophenol is measured by Ostwald's viscometer at 25° C., and IV is calculated according to the following approximate formula:

$$IV = 0.0242\ \eta r + 0.2634$$

wherein $\eta r$ is represented by $$\eta r = \frac{t \times d}{t_0 \times d_0},$$

in which t stands for the falling time (second) of the solution, $t_0$ stands for the falling time (seconds) of o-chlorophenol, d stands for the density (g/cc) of the solution and $d_0$ stands for the density (g/cc) of o-chlorophenol.

(2) Amorphous Orientation Function (fa)

The amorphous orientation function (fa) is calculated according to the following formula:

$$fa = \frac{\Delta n - Xcfc\Delta n\mathring{c}}{(1 - Xc)\Delta n\mathring{a}}$$

wherein Δn stands for the birefringence, Xc stands for the degree of crystallization, $\Delta n\mathring{c}$ stands for the intrinsic birefringence of the crystal, which is 0.220, $\Delta n\mathring{a}$ stands for the intrinsic birefringence of the amorphous region which is 0.275, and fc stands for the crystal orientation function.

A photograph of a diffraction pattern measured by wide angle X-ray diffractometry is analyzed with respect to average angular breadths of (010) and (100) diffraction arcs, to determine the average orientation angle θ, and the crystal orientation function (fc) is calculated according to the following formula:

$$fc = \tfrac{1}{2}(3\cos^2\theta - 1)$$

The birefringence Δn is determined by a polarization microscope according to the customary compensator method using D-rays as the light source.

(3) Degree (Xc) of Crystallization

The degree (Xc) of crystallization is determined according to the following formula by using the density ($\rho$:g/cm$^3$) of the fiber:

$$Xc = \frac{\rho c\,(\rho - \rho a)}{\rho\,(\rho c - \rho a)}$$

wherein $\rho$ is the density (g/cm$^3$) of the fiber, $\rho c$ is the density (g/cm$^3$) of the crystalline region, which is 1.455, and $\rho a$ is the density (g/cm$^3$) of the amorphous region, which is 1.335.

The density $\rho$ is determined at 25° C. according to the gradient tube density determination method using n-heptane and tetrachloromethane.

(4) Tenacity and Elongation at Break

The tenacity and elongation at break are determined according to the method stipulated in JIS L-1017 under the following conditions (the applied resin is not included in the denier of the treated cord).

Tensile tester: constant-rate extension type
Crosshead speed: 300 mm/min
Sample gauge length: 250 mm
Atmosphere: 20° C., 65% RH
Twist number: 8 turns/10 cm (5) Medium Elongation (ME)

According to the method stipulated in JIS L-1017, the medium elongation is determined by using the same tensile tester as used for determination of the tenacity and elongation at break.

The medium elongation (ME) of the raw yarn means the elongation (%) under a load of 4.5 g/d.

The medium elongation (ME) of either the greiged cord or the treated cord means the elongation (%) under a load of 2.25 g/d.

(6) Dry Heat Shrinkage (ΔS)

Filament yarn sample is taken up on a hank and allowed to stand for more than 24 hours in an air-conditioned room maintained at a temperature of 20° C. and a relative humidity of 65%, and the sample having a length $L_0$ as measured under a load of 0.1 g/d is allowed to stand under no tension for 30 minutes in an oven maintained at 150° C. The sample is taken out from the oven and allowed to stand for 4 hours in the above-mentioned air-conditioned room. Then, the length $L_1$ of the sample is measured under the same load as described above. The dry hot shrinkage (ΔS) is calculated according to the following formula:

$$\Delta S = \frac{L_0 - L_1}{L_0} \times 100\,(\%)$$

The dry hot shrinkage of the treated cord is determined in the same manner as described above except that the temperature in the oven is changed to 177° C.

(7) Fatigue Resistance (GY Fatigue Life)

In the GY fatigue test (Goodyear Mallory Fatigue Test), according to ASTM D-885, the time before the tube bursts is determined.

The end count of cords in the tube is 30 per inch, and the vulcanization is carried out at 160° C. for 20 minutes. The measurement conditions are as follows.

Internal pressure of tube: 3.5 kg/cm$^2$ G
Rotation speed: 850 rpm
Tube angle: 90°

(8) In-Rubber Heat Resistance

A sample cord of 1500 D/2 was wound on a frame under a load of 0.75 pound per cord and fixed in this state. The cord is gripped between upper and lower unvulcanized rubber sheets having a thickness of 1.1 mm, and vulcanization is carried out at 160° C. for 20 minutes under a pressure of 50 kg/cm$^2$G (sample K1) or at 160° C. for 6 hours under a pressure of 50 kg/cm$^2$G (sample K2). After the vulcanization, the tenacity of each sample is measured, and the tenacity retention ratio (heat resistance in a rubber) is calculated according to the following formula:

$$\text{Tenacity retention ratio} = \frac{\text{tenacity of } K2}{\text{tenacity of } K1} \times 100\%$$

The polyester fiber for industrial use according to the present invention is prepared by a novel process comprising the following steps:

(1) Shaping a polyester into chips, in which 90% by mole of total recurring units in the molecule chain of the polyester are composed of polyethylene terephthalate, and said polyester is highly pure to an extent such that particles of the incorporated substances including additives contained therein have a diameter of 1 to 10 μm and the content of said particles is not larger than 200 ppm; and subjecting the chips to a solid phase polymerization to obtain chips which has an intrinsic viscosity [IV] of 1.25 to 1.8 and in which the amount of broken chip pieces produced during the solid phase polymerization and having a volume not larger than 65% of the volume of the shaped chips is not larger than 500 ppm based on the weight of the entire chips;

(2) melting the polyester chips and spinning the molten polyester from a spinneret having up to 3 lines of extrusion orifices arranged annularly, to form a filament yarn;

(3) passing the as-spun filament yarn, immediately without rapid quenching through a high-temperature atmosphere maintained at 205 to 350° C. and having a length of 100 to 300 mm just below the spinneret, to effect slow cooling;

(4) introducing the slowly cooled spun filament yarn into a cooling chimney having a length of at least 100 mm and blowing a gas maintained at 50° to 120° C. to the periphery of the spun filament yarn at a speed of 15 to 50 m/min;

(5) introducing the spun filament yarn, which has passed through the cooling chimney, into a first spinning duct where the spun filament yarn is further cooled while a part of the associated gas present around and among the spun filament yarn is expelled, and introducing the spun filament yarn into a second spinning duct, below which an exhaust device is arranged where the spun filament yarn is further cooled while a part of the associated gas is expelled and disturbance of the gas current in the second spinning duct is prevented, to completely solidify the spun filament yarn;

(6) wrapping the completely solidified spun filament yarn on a take-off roll rotating at a high speed of 1,500 to 2,600 m/min, so that the birefringence of the spun filament yarn after the passage through the take-off roll is 0.025 to 0.060;

(7) delivering the spun filament yarn, which is wrapped on the take-off roll, to a multi-stage drawing zone directly without being wound on a take-up roll, where the spun filament yarn is drawn in a multi-stage at a total draw ratio of 2.2 to 2.65 and at a draw ratio in the first drawing stage of 1.45 to 2.00 and is subjected to an entangling treatment by applying a fluid in the midway of drawing while the spun filament yarn is drawn to obtain a drawn filament yarn; and (8) subjecting the drawn filament yarn coming from a final drawing roll arranged in the drawing zone to a relaxing treatment at a relax ratio of 4 to 10% while subjecting the drawn filament yarn to the entangling treatment, wrapping the drawn fiber on a relaxing roll not heated or heated at a temperature lower than 130° C., and then winding the drawn filament yarn at a speed of 3,500 to 5,500 m/min on a take-up roll.

The polyester fiber for industrial use according to the present invention is prepared by the process comprising the above-mentioned steps (1) through (8) in combination. Of these steps, combination (I) of the steps (1) and (2) and combination (II) of the steps (2), (3), (4) and (5) are important, and the combination of (I) and (II) with the step (8) is especially important. Namely, the polyester fiber of the present invention is prepared according to the unique process in which the preparation of polyethylene terephthalate, the multi-stage expelling of the gas associated with the as-spun filament yarn, the control of the quantity of expelling the associated gas, and the simultaneous execution of the entangling treatment and relaxing treatment are combined.

The relationship of the process for the preparation of the polyester fiber for industrial use according to the present invention with the properties of the polyester fiber for industrial use and the properties of the treated cord prepared from this polyester fiber for industrial use, that is, the functional effects, will now be described.

In the polyester used for the polyester fiber for industrial use according to the present invention, at least 90 mole % of the total recurring units of the molecule chain are composed of polyethylene terephthalate. The polyester used may contain up to 10 % by mole of ester units, other than ethylene terephthalate units, which ester units are derived independently from glycols, for example, a polyethylene glycol having up to 10 carbon atoms, diethylene glycol and hexahydro-p-xylene glycol, and from dicarboxylic acids, for example, isophthalic acid, hexahydroterephthalic acid, adipic acid, sebacic acid and azelaic acid.

The polyester used in the present invention has a high degree of purity such that particles of the incorporated substance including an additive, for example, for imparting the fatigue resistance does not exceed 10 μm and the amount of these incorporated substances is not larger than 200 ppm. This highly pure polyester is shaped into chips, and the chips are delivered to a solid phase polymerization apparatus where the chips are subjected to the solid phase polymerization.

During the delivery and solid phase polymerization, the chips impinge against a delivery passage and a solid polymerization apparatus whereby some chips are often broken. Accordingly, cushioning materials are arranged in the delivery passage and the solid phase polymerization apparatus and/or the delivery speed is controlled so that an impingement between chips and breakage of chips do not occur.

If broken pieces of chips are formed during the course between the solid phase polymerization and melt spinning, a broken piece-separating apparatus is disposed and the broken pieces are separated to an extent such that the amount of broken chip pieces having a volume not larger than 65% of the volume of the shaped chips is not larger than 500 ppm based on the weight of the entire chips to be melt-spun. The conditions of the solid phase polymerization are set so that the intrinsic viscosity [IV] of the chips is in the range of from 1.25 to 1.8, and if the intrinsic viscosity [IV] of the chips is adjusted to 1.25 to 1.8, the intrinsic viscosity [IV] of the polyester fiber obtained through melt-spinning and drawing can be maintained within the range of from 0.97 to 1.15.

If the amount of the five particles included in the polyethylene terephthalate exceeds 200 ppm and the amount of the broken pieces incorporated into the chips exceeds 500 ppm, the tenacity and elongation of the polyester fiber obtained through melt-spinning and drawing and those of the greige cord and treated cord prepared from this polyester fiber are reduced, and the formation of fluff and broken filaments becomes conspicuous at the drawing step and a high-draw ratio drawing is impossible. This is because the quality of single filaments in the substance-incorporated portions and the portions formed by melting of the broken chip pieces is different from the quality of single filaments the other portions of the filaments.

Where the incorporation ratio of the broken pieces in chips exceeds 500 ppm at the solid phase polymerization conducted before the melt-spinning and drawing of chips, the degree of polymerization is increased in the broken pieces over the level obtained in normal chips, and the obtained polyester fiber partially has a higher intrinsic viscosity [IV], and the tenacity becomes higher in this part but the tenacity-elongation product is low, with the result that dispersion appears in the length direction of one single filament and among single filaments, and reduction of the tenacity is extreme in the treated cord prepared from this polyester fiber and improvement of the fatigue resistance (GY fatigue life) cannot be expected.

Namely, by adjusting the intrinsic viscosity [IV] of the polyester fiber to 0.97 to 1.15 and the amount of the incorporated substances including additives to a level lower than 200 ppm, the tenacity of the cord is not reduced when the treated cord is prepared from the obtained polyester fiber, and the tenacity retention ratio and fatigue resistance can be improved.

Nevertheless, the quality of the treated cord cannot be satisfactory improved only by controlling the intrinsic viscosity [IV] of the polyester fiber, the amount of the incorporated substances including additives and the amount of broken chip pieces. These factors are indispensable for improving the tenacity retention ratio and fatigue resistance, and by combining these requirements with other conditions described below, synergestic effects are obtained and the intended polyester fiber for industrial fiber according to the present invention is obtained.

The polyester chips which have passed through the solid phase polymerization are melt-spun and drawn in a melt-spinning and drawing apparatus.

The spinneret has up to 3 lines of extrusion orifices arranged annually and concentrically, so that the residence time in the molten state and the heating and cooling degrees are uniformalized among single filaments constituting the as-spun filament yarn. The polyester fiber extruded from the extrusion orifices is not directly subjected to rapid quenching but is passed through a high-temperature atmosphere zone maintained at 205° to 350° C. to effect a slow cooling.

The length of the high-temperature atmosphere zone is 100 to 300 mm, and a heating zone is disposed to positively heat the atmosphere. The high-temperature atmosphere comprises the heating zone for positive heating from the outer periphery and, if necessary, a non-heating zone disposed below the heating zone.

The temperature of the high-temperature atmosphere is measured substantially at the center of the polyester filaments running in the form of up to three circles, that is, the ring formed by respective filaments of the spun filament yarn.

The spun filament yarn which has passed through the high-temperature atmosphere zone is passed through a cooling chimney having a length of at least 100 mm. In the cooling chimney, a gas maintained at 50° to 120° C. is blown at a rate of 15 to 50 m/min to the periphery of the ring formed by respective filaments of the spun filament yarn to quench the respective filaments under substantially uniform conditions. The gas used is selected from, for example, air, inert gases and humidified air.

By passing the spun filament yarn through the heating zone and then through the cooling chimney in the above-mentioned manner, the cooling gradient of the spun filament yarn is greatly changed.

The spun filament yarn which has passed through the cooling chimney is passed through a first spinning duct, and a second spinning duct below which an exhaust device is arranged. In the first spinning duct, the gas associated with the spun filament yarn is expelled and a part of the associated gas is substituted with other gas to gradually cool the spun filament yarn. In the second spinning duct, the spun filament yarn is passed through the first half thereof in the stable state and a part of the associated gas is gradually substituted with other gas in the latter half thereof. Thus, multi-stage substitution of the associated gas is effected and cooling of the spun filament yarn is substantially uniformly advanced while controlling any disturbance, that is, fluctuation, of respective filaments of the spun filament yarn.

By adopting the above-mentioned orifice arrangement in the spinneret and the above-mentioned high-temperature atmosphere and cooling conditions, the quality of respective spun yarn-constituting filaments is stabilized, and all of the requirements of the tenacity-elongation product, dimensional stability index and amorphous orientation function of the polyester fiber are satisfied and the treated cord prepared from this polyester fiber has a high tenacity and elongation at break, and satisfactory dimensional stability index and fatigue resistance.

The cooled and solidified polyester fiber is wrapped on a take-off roll rotating at a high speed of 1,500 to 2,600 m/min, and subsequently, the polyester fiber is delivered directly (i.e., without being wound on a take-up roll) to a multi-stage drawing zone where the fiber is drawn in a multi-stage at a total draw ratio of 2.2 to 2.65 and at a draw ratio in the first drawing stage of 1.45 to 2.00, and simultaneously, the polyester fiber is subjected to an entangling treatment with a fluid midway in the drawing while the fiber is drawn, to obtain a drawn yarn.

If the above-mentioned take-off speed is lower than 1,500 m/min, the dimensional stability index of the drawn polyester fiber becomes too high and the amorphous orientation function is also too high, and the tenacity and elongation of the treated cord are low and the fatigue resistance is degraded. If the take-off speed exceeds 2,600 m/min, the tenacity-elongation product of the polyester fiber is reduced, and the treated cord prepared from the polyester fiber has a poor in-rubber heat resistance.

If the draw ratio in the first drawing stage is lower than 1.45, single filament breakage often occurs during the drawing and the treated cord has a poor tenacity retention ratio. If the draw ratio in the first drawing stage is higher than 2.00, single filament breakage and yarn breakage often occur and it becomes impossible to smoothly effect the drawing.

If the total draw ratio is lower than 2.5, the tenacity of the polyester fiber is low and the treated cord has a poor tenacity and in-rubber heat resistance. If the total draw ratio is higher than 2.65, the elongation of the polyester fiber is low although the tenacity is high, and in the treated cord, the reduction of the tenacity is extreme and the elongation and fatigue resistance are not satisfactory.

The drawn yarn which has been drawn at a total draw ratio of 2.2 to 2.65 in the above-mentioned manner and exits from a final draw roll is relaxed at a ratio of 4 to 10% while the drawn yarn is subjected to an entangling treatment between the final draw roll and a relax roll. The drawn yarn is then wound at a speed of 3,500 to 5,500 m/min. Accordingly, the intended polyester fiber of the present invention is obtained.

If the relax ratio is lower than 4%, the medium elongation and elongation at break of the polyester fiber are low, and the treated cord has a poor elongation at break and fatigue resistance. If the relax ratio exceeds 10%, the tenacity of the polyester fiber is low and the medium elongation is too high, and formation of broken filaments often occurs on the relax roll and in the vicinity of the relax roll, with the result that the percentage of full package is reduced. Moreover, the fatigue resistance and in-rubber heat resistance of the treated cord prepared from the polyester fiber are low.

As apparent from the foregoing description, the polyester fiber for industrial use according to the present invention, which is especially suitable as a rubber reinforcer, is prepared by the above-mentioned process in which synergestic effects are obtained by the combination of unique steps of spanning from the condensation polymerization of polyethylene terephthalate to the winding after drawing and relaxing.

Where the thus-obtained substantially untwisted polyester fiber is used for reinforcing a rubber, one or a plurality of the above-mentioned polyester fibers are combined and twisted to form a first twist yarn, and at least two of such first twist yarns are combined and twisted in the direction opposite to the first twist direction to form a final twist yarn, that is, a greige cord. In the formation of the greige cord, the twist coefficient for the first twist is 1,850 to 2,600 and the twist coefficient for the final twist is the same as or almost equal to the twist coefficient for the first twist, and the total denier of the greige cord is adjusted to 1,600 to 4,500. The obtained greige cord has excellent high-tenacity and high-toughness characteristics.

When an adhesive is applied to the greige cord obtained by twisting the substantially untwisted polyester fiber of the present invention and heat setting is carried out at a temperature of at least 230° C., a treated cord having an excellent dimensional stability, a high tenacity and a high toughness, which is preferably used as a reinforcer for a rubber structure, is obtained.

The invention will be described by the following examples.

EXAMPLES 1 THROUGH 21 AND COMPARATIVE EXAMPLES 1 THROUGH 21

Polyethylene terephthalate was prepared by condensation polymerization and shaped into chips, and the chips were subjected to solid phase polymerization to obtain polyester chips having a high degree of polymerization. A variety of chips differing in the degree of polymerization, the presence or absence of the included substances having a particle diameter larger than 10 μm, the amount of the included substances having a particle diameter smaller than 10 μm, and the size and amount of broken chip pieces formed at the solid phase polymerization and the delivery of chips, were prepared and subjected to the melt-spinning test.

A coupled spin-drawing apparatus was used as the melt-spinning apparatus, and the melt-spinning machine in this apparatus was an extruder. The temperature of the molten polymer and the temperature of a molten polymer delivery pipe were adjusted in the range of from 285° to 305° C. and the temperature of the melt-spinning zone was adjusted within the range of from 295° to 305° C., so that the intrinsic viscosity of the obtained polyester fiber was from 0.95 to 1.19.

A spinneret having an orifice diameter of 0.60 mm and an orifice number of 240 was used. In view of the spinning and drawing conditions, the extrusion rate of the molten polymer was adjusted within the range of from 402.9 to 625.5 g/min so that the denier of the obtained polyester fiber (raw yarn) was about 1,000.

The properties of the respective chips and the melt-spinning test conditions are shown in Tables 1-(1) through 1-(8).

When a treated cord was prepared by applying an adhesive to a greige cord and carrying out heat setting, an adhesive composed mainly of a resorcinol-formalin latex and "Vulcabond E" supplied by Vulnax Co. was used as the adhesive and the greige cord was passed through the adhesive. The adhesive concentration (in the RFL mixture) was adjusted to 20% by weight, so that the pick-up of the adhesive was 3% by weight. After the application of the adhesive, the cord was treaded under a constant stretch condition for 60 seconds in a drying zone maintained at 160° C., and the cord was subjected to a hot stretching treatment for 70 seconds in a hot stretching zone maintained at 245° C. at a stretch ratio such that the medium elongation of the treated cord was about 3.5%. Then, the cord was subjected to a relax heat treatment in a normalizing zone maintained at 245° C. while giving a relax of 1%, whereby a treated cord was obtained.

Physical properties of the respective drawn filament yarns obtained at the melt-spinning test are shown in Tables 2-(1) through 2-(8).

Of the properties shown in Tables 2-(1) through 2-(8), the birefringence [Δn] of the undrawn filament yarn was measured with respect to the undrawn yarn wound and collected on a winder from the take-off roller.

Of the properties shown in Tables 2-(1) through 2-(8), the in-rubber heat resistance and the fatigue resistance (GY fatigue life) were measured with respect to a cured cord obtained by curing the treated cord.

As shown in Tables 2-(1) through 2-(8) and as apparent from the properties of the raw yarn, greige cord and treated cord, the polyester fiber of the present invention has excellent properties, and changes of the characteristics are very small at the twisting operation for forming the greige cord and the dipping treatment for forming the treated cord. Furthermore, the defect that if one property is improved, another property is degraded, as shown in the comparative examples, can be overcome in the polyester fiber of the present invention, and the polyester fiber of the present invention has excellent tenacity, elongation at break, medium elongation, shrinkage, dimensional stability index and tenacity retention ratio, and the cured cord obtained by curing the treated cord has excellent in-rubber heat resistance and fatigue resistance (GY fatigue life). Namely, these properties are greatly improved and well balanced, and the polyester fiber of the present invention is suitable for industrial use, especially for reinforcing a rubber.

Moreover, as apparent from Tables 2-(1), 2-(3), 2-(5) and 2-(7), where a polyester fiber is prepared by using chips having a high IV, the yarn-forming properties are greatly influences by the heating and cooling conditions such as the temperature and length of the heating zone below the spinneret and the air temperature, length and air speed of the circular quench chamber, the temperature of the draw roll and the relax ratio after drawing of the polyester fiber. Namely, to obtain good yarn-forming properties while controlling the formation of broken fibers and other defects, preferably the shrinkage (Δs) of the polyester fiber in hot air at 150° C. for 30 minutes is in the range of $2 \leqq \Delta S \leqq = 4.5$.

TABLE 1

| | Example 1 | Example 2 | Example 3 | Example 4 | Example 5 | Example 6 | Example 7 | Example 8 | Example 9 | Example 10 | Example 11 | Example 12 | Example 13 | Example 14 | Example 15 | Example 16 |
|---|---|---|---|---|---|---|---|---|---|---|---|---|---|---|---|---|
| Chip | | | | | | | | | | | | | | | | |
| Incorporated substance of diameter exceeding 10 μm | No | No | No | No | No | No | No | No | No | No | No | No | No | No | No | No |
| Amount of incorporated substances of 1-10 μm diameter (ppm) | 10 | 180 | 180 | 180 | 180 | 180 | 13 | 25 | 32 | 32 | 32 | 32 | 32 | 32 | 32 | 32 |
| Amount of broken chip pieces (ppm) | 250 | 450 | 450 | 450 | 450 | 450 | 220 | 260 | 300 | 300 | 300 | 300 | 300 | 300 | 300 | 300 |
| Intrinsic viscosity [IV] | 1.5 | 1.25 | 1.8 | 1.8 | 1.8 | 1.5 | 1.3 | 1.65 | 1.8 | 1.5 | 1.5 | 1.5 | 1.5 | 1.5 | 1.5 | 1.5 |
| Spinning conditions | | | | | | | | | | | | | | | | |
| Number of annular lines of orifices in spinneret | 2 | 3 | 3 | 3 | 3 | 2 | 2 | 2 | 2 | 2 | 2 | 2 | 2 | 2 | 2 | 2 |
| Temperature of heated zone immediately below spinneret (°C.) | 320 | 275 | 320 | 350 | 350 | 320 | 280 | 325 | 340 | 340 | 320 | 320 | 320 | 320 | 320 | 320 |
| Length of heated zone immediately below spinneret (mm) *1 | 120 | 100 | 200 | 300 | 300 | 120 | 120 | 200 | 200 | 200 | 120 | 120 | 120 | 120 | 120 | 120 |
| Length of non-heated zone below spinneret (mm) *1 | 80 | 0 | 0 | 0 | 0 | 80 | 20 | 30 | 80 | 80 | 80 | 80 | 80 | 80 | 30 | 80 |
| Temperature of cooling air in cooling chimney (°C.) | 80 | 50 | 50 | 50 | 120 | 80 | 80 | 80 | 80 | 60 | 70 | 80 | 80 | 80 | 80 | 80 |
| Length of cooling chimney (mm) | 200 | 100 | 100 | 100 | 100 | 200 | 200 | 200 | 200 | 200 | 350 | 200 | 200 | 200 | 200 | 200 |
| Air speed in cooling chimney (m/min) | 30 | 15 | 45 | 45 | 30 | 30 | 30 | 30 | 30 | 30 | 20 | 30 | 30 | 30 | 30 | 30 |
| Air speed in first spinning duct (m/min) | 10 | 5 | 10 | 10 | 20 | 10 | 10 | 10 | 10 | 10 | 20 | 10 | 10 | 10 | 10 | 10 |
| Air speed in second spinning duct (m/min) | 22 | 15 | 20 | 20 | 25 | 22 | 22 | 22 | 22 | 22 | 25 | 22 | 22 | 22 | 22 | 22 |
| Spinning speed (m/min) | 2170 | 2600 | 1500 | 1500 | 2600 | 2170 | 2170 | 2170 | 2170 | 2170 | 2170 | 2350 | 1900 | 2170 | 2170 | 2170 |
| Drawing and other conditions | | | | | | | | | | | | | | | | |
| Number of drawing stages | 4 | 4 | 4 | 4 | 4 | 4 | 4 | 4 | 4 | 4 | 4 | 4 | 4 | 2 | 3 | 4 |
| Drawing ratio in first drawing stage | 1.74 | 1.63 | 1.95 | 1.95 | 1.60 | 1.74 | 1.74 | 1.74 | 1.74 | 1.74 | 1.74 | 1.74 | 1.74 | 1.74 | 1.74 | 1.74 |
| Entangle treatment in multistage drawing | Effected | Effected | Effected | Effected | Effected | Effected | Effected | Effected | Effected | Effected | Effected | Effected | Effected | Effected | Effected | Effected |
| Total drawing ratio | 2.35 | 2.21 | 2.63 | 2.63 | 2.22 | 2.35 | 2.37 | 2.34 | 2.40 | 2.52 | 2.35 | 2.29 | 2.45 | 2.35 | 2.35 | 2.27 |
| Relax ratio (%) | 6.5 | 4.0 | 6.0 | 10.0 | 4.0 | 6.5 | 6.5 | 6.5 | 6.5 | 6.5 | 6.5 | 6.5 | 6.5 | 6.5 | 6.5 | 6.5 |
| Entangle treatment in relaxation step | Effected | Effected | Effected | Effected | Effected | Effected | Effected | Effected | Effected | Effected | Effected | Effected | Effected | Effected | Effected | Effected |
| Heating of relaxing roller (°C.) | Not effected | Not effected | Not effected | Not effected | Not effected | Not effected | Not effected | Not effected | Not effected | Not effected | Not effected | Not effected | Not effected | Not effected | Not effected | Not effected |
| Take-up speed (m/min) | 4794 | 5492 | 3708 | 3551 | 5426 | 4794 | 4809 | 4748 | 4869 | 5113 | 4794 | 5032 | 4352 | 4794 | 4794 | 4606 |

TABLE 1-continued

| | Example 17 | Example 18 | Example 19 | Example 20 | Example 21 | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|---|---|---|---|---|
| Chip | | | | | | | | | | | | | | |
| Incorporated substance of diameter exceeding 10 μm | No | No | No | No | No | Present | No | No | No | No | No | No | No | No |
| Amount of incorporated substances of 1-10 μm diameter (ppm) | 32 | 32 | 32 | 32 | 32 | 1100 | 1000 | 10 | 10 | 10 | 10 | 10 | 10 | 10 |
| Amount of broken chip pieces (ppm) | 300 | 300 | 300 | 300 | 300 | 2500 | 2500 | 250 | 250 | 250 | 250 | 250 | 250 | 250 |
| Intrinsic viscosity [IV] | 1.5 | 1.5 | 1.5 | 1.5 | 1.5 | 1.5 | 1.5 | 1.2 | 2.0 | 1.5 | 1.5 | 1.5 | 1.5 | 1.5 |
| Spinning conditions | | | | | | | | | | | | | | |
| Number of annular lines of orifices in spinneret | 2 | 2 | 2 | 2 | 2 | 2 | 2 | 2 | 2 | 5 | 2 | 2 | 2 | 2 |
| Temperature of heated zone immediately below spinneret (°C.) | 320 | 320 | 320 | 320 | 320 | 320 | 320 | 320 | 320 | 320 | 360 | 320 | 320 | 320 |
| Length of heated zone immediately below spinneret (mm) | 120 | 120 | 120 | 120 | 120 | 120 | 120 | 120 | 120 | 120 | 80 | 300 | 120 | 120 |
| Length of non-heated zone below spinneret (mm) | 80 | 80 | 80 | 80 | 80 | 80 | 80 | 80 | 80 | 80 | 0 | 100 | 80 | 80 |
| Temperature of cooling air in cooling chimney (°C.) | 80 | 80 | 80 | 80 | 80 | 80 | 80 | 80 | 80 | 80 | 80 | 80 | 20 | 130 |
| Length of cooling chimney (mm) | 200 | 200 | 200 | 200 | 200 | 200 | 200 | 200 | 200 | 200 | 200 | 200 | 200 | 200 |
| Air speed in cooling chimney (m/min) | 30 | 20 | 30 | 30 | 30 | 30 | 30 | 30 | 30 | 30 | 30 | 30 | 30 | 30 |
| Air speed in first spinning duct (m/min) | 10 | 20 | 10 | 10 | 10 | 10 | 10 | 10 | 10 | 10 | 10 | 10 | — | — |
| Air speed in second spinning duct (m/min) | 22 | 25 | 22 | 22 | 22 | 22 | 22 | 22 | 22 | 22 | 22 | 22 | 22 | 22 |
| Spinning speed (m/min) | 2170 | 2170 | 2170 | 2170 | 2170 | 2170 | 2170 | 2170 | 2170 | 2170 | 2170 | 2120 | 2170 | 2170 |
| Drawing and other conditions | | | | | | | | | | | | | | |
| Number of drawing stages | 4 | 4 | 4 | 4 | 4 | 4 | 4 | 4 | 4 | 4 | 4 | 4 | 4 | 4 |
| Drawing ratio in first drawing stage | 1.74 | 1.74 | 1.74 | 1.74 | 1.74 | 1.74 | 1.74 | 1.74 | 1.74 | 1.74 | 1.74 | 1.74 | 1.74 | 1.74 |
| Entangle treatment in multistage drawing | Effected | Effected | Effected | Effected | Effected | Effected | Effected | Effected | Effected | Effected | Effected | Effected | Effected | Effected |
| Total drawing ratio | 2.45 | 2.55 | 2.35 | 2.35 | 2.35 | 2.35 | 2.35 | 2.51 | 2.15 | 2.35 | 2.24 | 2.76 | 2.34 | 2.67 |
| Relax ratio (%) | 6.5 | 6.5 | 4.0 | 8.0 | 9.5 | 6.5 | 6.5 | 6.5 | 6.5 | 6.5 | 6.5 | 6.5 | 6.5 | 6.5 |
| Entangle treatment in relaxation step | Effected | Effected | Effected | Effected | Effected | Effected | Effected | Effected | Effected | Effected | Effected | Effected | Effected | Effected |
| Heating of relaxing roller (°C.) | Not effected | Not effected | Not effected | Not effected | 120 | Not effected | Not effected | Not effected | Not effected | Not effected | Not effected | Not effected | Not effected | Not effected |
| Take-up speed (m/min) | 4971 | 5174 | 4896 | 4794 | 4794 | 4794 | 4794 | 5093 | 4362 | 4794 | 4862 | 5471 | 4748 | 5417 |

TABLE 1-continued

| | Comparative Example 10 | Comparative Example 11 | Comparative Example 12 | Comparative Example 13 | Comparative Example 14 | Comparative Example 15 | Comparative Example 16 | Comparative Example 17 | Comparative Example 18 | Comparative Example 19 | Comparative Example 20 | Comparative Example 21 *1 |
|---|---|---|---|---|---|---|---|---|---|---|---|---|
| Chip | | | | | | | | | | | | |
| Incorporated substance of diameter exceeding 10 μm | No | No | No | No | No | No | No | No | No | No | No | No |
| Amount of incorporated substances of 1-10 μm diameter (ppm) | 10 | 10 | 10 | 10 | 10 | 10 | 10 | 10 | 10 | 10 | 10 | 1000 |
| Amount of broken chip pieces (ppm) | 250 | 250 | 250 | 250 | 250 | 250 | 250 | 250 | 250 | 250 | 250 | 2500 |
| Intrinsic viscosity [IV] | 1.5 | 1.5 | 1.5 | 1.5 | 1.5 | 1.5 | 1.5 | 1.5 | 1.5 | 1.5 | 1.5 | 1.3 |
| Spinning conditions | | | | | | | | | | | | |
| Number of annular lines of orifices in spinneret | 2 | 2 | 2 | 2 | 2 | 2 | 2 | 2 | 2 | 2 | 2 | 5 |
| Temperature of heated zone immediately below spinneret (°C.) | 320 | 320 | 320 | 320 | 320 | 320 | 320 | 320 | 320 | 320 | 320 | 300 |
| Length of heated zone immediately below spinneret (mm) | 120 | 120 | 120 | 120 | 120 | 120 | 120 | 120 | 120 | 120 | 120 | 120 |
| Length of non-heated zone below spinneret (mm) | 80 | 80 | 80 | 80 | 80 | 80 | 80 | 80 | 80 | 80 | 80 | 80 |
| Temperature of cooling air in cooling chimney (°C.) | 80 | 80 | 80 | 80 | 80 | 80 | 80 | 80 | 80 | 80 | 80 | 25 |
| Length of cooling chimney (mm) | 80 | 500 | 200 | 200 | 200 | 200 | 200 | 200 | 200 | 200 | 200 | 250 |
| Air speed in cooling chimney (m/min) | 55 | 12 | 30 | 30 | 30 | 30 | 30 | 30 | 30 | 30 | 30 | 35 |
| Air speed in first spinning duct (m/min) | 10 | 10 | 10 | 10 | 10 | 10 | 10 | 10 | 10 | 10 | 10 | — |
| Air speed in second spinning duct (m/min) | 22 | 22 | 22 | 22 | 22 | 22 | 22 | 22 | 22 | 22 | 22 | — |
| Spinning speed (m/min) | 2170 | 2170 | 1445 | 2700 | 2170 | 2170 | 2170 | 2170 | 2170 | 2170 | 2170 | 2141 |
| Drawing and other conditions | | | | | | | | | | | | |
| Number of drawing stages | 4 | 4 | 4 | 4 | 4 | 4 | 4 | 4 | 4 | 4 | 4 | 3 |
| Drawing ratio in first drawing stage | 1.74 | 1.74 | 1.87 | 1.62 | 1.38 | 2.05 | 1.74 | 1.59 | 2.00 | 1.74 | 1.74 | 1.65 |
| Entangle treatment in multistage drawing | Effected | Effected | Effected | Effected | Effected | Effected | Not Effected | Effected | Effected | Effected | Effected | Not Effected |
| Total drawing ratio | 2.35 | 2.35 | 2.60 | 2.25 | 2.35 | 2.35 | 2.35 | 2.15 | 2.70 | 2.35 | 2.35 | 2.37 |
| Relax ratio (%) | 6.5 | 6.5 | 6.5 | 6.5 | 6.5 | 6.5 | 6.5 | 6.5 | 6.5 | 1.5 | 11.0 | 1.5 |
| Entangle treatment in relaxation step | Effected | Effected | Effected | Effected | Effected | Effected | Effected | Effected | Effected | Effected | Effected | Not Effected |
| Heating of relaxing roller (°C.) | Not effected | Not effected | Not effected | Not effected | Not effected | Not effected | Not effected | Not effected | Not effected | Not effected | Not effected | Not effected |
| Take-up speed (m/min) | 4794 | 4794. | 3513 | 5680 | 4794 | 4794 | 4794 | 4362 | 5478 | 4794 | 4590 | 5000 |

*1 Comparative Example 21. ROY/DY was tested.

TABLE 2

| | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| Properties of raw yarn | | | | | | | | | | | |
| Birefringence of undrawn yarn [Δn] × $10^{-3}$ | 38 | 55 | 29 | 27 | 54 | 38 | 37 | 38 | 35 | 32 | 45 |
| Intrinsic viscosity [IV] | 1.05 | 0.97 | 1.10 | 1.15 | 1.10 | 1.05 | 1.10 | 1.10 | 1.15 | 1.05 | 1.05 |
| Fineness (denier) | 1034 | 1024 | 1042 | 1068 | 1025 | 1030 | 1029 | 1030 | 1031 | 1031 | 1030 |
| Strength (kg) | 9.13 | 8.24 | 9.85 | 10.09 | 8.25 | 8.70 | 9.06 | 9.02 | 9.18 | 9.08 | 9.14 |
| Tenacity (g/d) | 8.83 | 8.05 | 9.45 | 9.45 | 8.05 | 8.45 | 8.80 | 8.76 | 8.65 | 8.81 | 8.87 |
| Elongation at break (%) | 13.4 | 13.9 | 11.2 | 13.7 | 16.8 | 13.0 | 11.8 | 14.2 | 12.2 | 13.9 | 11.5 |
| Product of tenacity × elongation (g/d · %) | 32.3 | 30.0 | 32.0 | 35.0 | 33.0 | 30.5 | 30.2 | 33.4 | 30.2 | 32.8 | 30.2 |
| Medium elongation (%) | 6.3 | 6.4 | 6.2 | 10.0 | 6.4 | 6.3 | 6.1 | 6.3 | 6.4 | 6.4 | 6.2 |
| Dry hot shrinkage (%) | 3.3 | 2.3 | 3.3 | 2.4 | 2.3 | 3.3 | 3.4 | 3.4 | 3.8 | 4.0 | 2.6 |
| Dimensional stability index (%) | 9.1 | 8.1 | 8.5 | 10.2 | 8.1 | 9.1 | 9.0 | 9.2 | 9.6 | 9.8 | 8.3 |
| Amorphous orientation function [fa] | 0.51 | 0.44 | 0.52 | 0.54 | 0.44 | 0.51 | 0.51 | 0.51 | 0.52 | 0.53 | 0.45 |
| Yarn-forming property | | | | | | | | | | | |
| Number of yarn breakage/ton | 1.5 | 4.1 | 1.7 | 1.2 | 4.3 | 2.3 | 0.9 | 2.5 | 4.5 | 3.7 | 4.2 |
| Number of single filament breakage/1,000 m | 1.3 | 6.3 | 1.5 | 1.1 | 7.2 | 3.3 | 1.1 | 3.2 | 7.5 | 3.4 | 7.1 |
| Properties of greige cord | | | | | | | | | | | |
| No. of twists in first twist (T/10 cm) | 50 | 50 | 50 | 50 | 50 | 50 | 50 | 50 | 50 | 50 | 50 |
| No. of twists in final twist (T/10 cm) | 50 | 50 | 50 | 50 | 50 | 50 | 50 | 50 | 50 | 50 | 50 |
| Twist coefficient in first twist | 2395 | 2391 | 2410 | 2441 | 2390 | 2395 | 2395 | 2395 | 2395 | 2395 | 2395 |
| Fineness (Denier) | 2295 | 2286 | 2324 | 2384 | 2285 | 2293 | 2300 | 2298 | 2295 | 2296 | 2291 |
| Strength (kg) | 16.42 | 15.33 | 16.52 | 16.78 | 15.68 | 15.82 | 16.32 | 16.59 | 16.11 | 16.44 | 15.73 |
| Tenacity (g/d) | 7.15 | 6.71 | 7.01 | 7.04 | 6.86 | 6.90 | 7.10 | 7.22 | 7.02 | 7.16 | 6.87 |
| Elongation at break (%) | 20.5 | 18.3 | 16.2 | 20.2 | 21.3 | 18.5 | 20.1 | 20.8 | 19.1 | 20.8 | 18.3 |
| Medium elongation [ME] (%) | 7.3 | 7.2 | 7.0 | 10.6 | 7.2 | 7.3 | 7.3 | 7.4 | 7.3 | 7.3 | 7.2 |
| Tenacity retention ratio (%) | 90.6 | 93.0 | 83.4 | 83.2 | 95.0 | 90.9 | 86.0 | 91.9 | 87.6 | 90.5 | 86.1 |
| Properties of treated cord | | | | | | | | | | | |
| Fineness (Denier) | 2213 | 2225 | 2229 | 2231 | 2224 | 2212 | 2212 | 2215 | 2218 | 2216 | 2220 |
| Strength (kg) | 15.80 | 15.04 | 15.07 | 14.99 | 14.99 | 15.24 | 15.58 | 15.93 | 15.53 | 15.15 | 15.11 |
| Tenacity (g/d) | 7.14 | 6.72 | 6.76 | 6.72 | 6.74 | 6.89 | 7.04 | 7.19 | 7.00 | 6.84 | 6.81 |
| Elongation at break (%) | 13.6 | 12.0 | 12.5 | 12.0 | 12.6 | 13.0 | 13.1 | 13.7 | 13.5 | 12.5 | 12.8 |
| Medium elongation (%) | 3.5 | 3.5 | 3.5 | 3.5 | 3.5 | 3.5 | 3.5 | 3.5 | 3.5 | 3.5 | 3.5 |
| Dry hot shrinkage at 177° C. [ΔS] (%) | 4.4 | 3.6 | 4.7 | 5.3 | 3.5 | 4.4 | 4.4 | 4.7 | 5.0 | 5.2 | 4.0 |
| Dimensional stability index [Y] (%) | 7.9 | 7.1 | 8.2 | 8.8 | 7.0 | 7.9 | 7.9 | 8.2 | 8.5 | 8.7 | 7.5 |
| Tenacity retention ratio (%) | 96.2 | 98.1 | 91.2 | 98.3 | 95.6 | 96.3 | 95.5 | 96.0 | 96.4 | 92.2 | 96.1 |
| In-rubber heat resistance (%) | 72 | 60 | 66 | 76 | 60 | 68 | 72 | 73 | 73 | 74 | 66 |
| Fatigue resistance (min) (GY fatigue life) | 308 | 223 | 277 | 250 | 296 | 260 | 248 | 325 | 346 | 232 | 255 |

| | Example 12 | Example 13 | Example 14 | Example 15 | Example 16 | Example 17 | Example 18 | Example 19 | Example 20 | Example 21 |
|---|---|---|---|---|---|---|---|---|---|---|
| Properties of raw yarn | | | | | | | | | | |
| Birefringence of undrawn yarn [Δn] × $10^{-3}$ | 46 | 30 | 38 | 38 | 39 | 38 | 38 | 38 | 38 | 38 |
| Intrinsic viscosity [IV] | 1.05 | 1.05 | 1.05 | 1.15 | 1.05 | 1.05 | 1.05 | 1.05 | 1.05 | 1.05 |
| Fineness (denier) | 1032 | 1031 | 1031 | 1030 | 1030 | 1029 | 1030 | 1025 | 1053 | 1063 |
| Strength (kg) | 9.11 | 9.08 | 9.09 | 9.08 | 8.66 | 9.47 | 9.73 | 9.12 | 8.90 | 8.82 |
| Tenacity (g/d) | 8.83 | 8.81 | 8.82 | 8.82 | 8.41 | 9.20 | 9.45 | 8.90 | 8.45 | 8.30 |
| Elongation at break (%) | 12.8 | 13.9 | 13.6 | 13.4 | 15.1 | 11.8 | 11.0 | 12.7 | 15.5 | 16.6 |
| Product of tenacity × elongation (g/d · %) | 31.6 | 32.8 | 32.5 | 32.3 | 32.7 | 31.9 | 31.3 | 31.7 | 33.3 | 33.5 |
| Medium elongation (%) | 6.3 | 6.4 | 6.5 | 6.4 | 6.7 | 5.9 | 5.6 | 5.5 | 8.2 | 9.7 |
| Dry hot shrinkage (%) | 2.9 | 3.7 | 3.1 | 3.2 | 3.1 | 3.5 | 4.0 | 4.2 | 2.6 | 2.1 |
| Dimensional stability index (%) | 8.7 | 9.5 | 9.0 | 9.0 | 9.1 | 9.0 | 9.3 | 9.5 | 9.4 | 9.7 |
| Amorphous orientation function [fa] | 0.51 | 0.52 | 0.51 | 0.51 | 0.52 | 0.53 | 0.45 | 0.51 | 0.50 | 0.49 |
| Yarn-forming property | | | | | | | | | | |
| Number of yarn breakage/ton | 2.8 | 1.2 | 4.2 | 2.6 | 0.5 | 2.9 | 4.2 | 1.7 | 2.0 | 3.6 |
| Number of single filament breakage/1,000 m | 4.9 | 1.0 | 9.4 | 1.8 | 0.8 | 3.1 | 7.4 | 1.6 | 1.3 | 1.4 |

TABLE 2-continued

| | | | | | | | | | | |
|---|---|---|---|---|---|---|---|---|---|---|
| Properties of greige cord | | | | | | | | | | |
| No. of twists in first twist (T/10 cm) | 50 | 50 | 50 | 50 | 50 | 50 | 50 | 50 | 50 | 50 |
| No. of twists in final twist (T/10 cm) | 50 | 50 | 50 | 50 | 50 | 50 | 50 | 50 | 50 | 50 |
| Twist coefficient in first twist | 2395 | 2395 | 2395 | 2395 | 2409 | 2409 | 2409 | 2409 | 2424 | 2435 |
| Fineness (Denier) | 2293 | 2294 | 2290 | 2297 | 2322 | 2324 | 2324 | 2285 | 2350 | 2372 |
| Strength (kg) | 16.28 | 16.36 | 16.30 | 16.45 | 16.22 | 16.78 | 16.29 | 16.34 | 16.43 | 16.55 |
| Tenacity (g/d) | 7.10 | 7.13 | 7.12 | 7.16 | 6.98 | 7.22 | 7.01 | 7.15 | 6.99 | 6.98 |
| Elongation at break (%) | 19.7 | 20.2 | 20.6 | 20.1 | 20.9 | 17.7 | 16.1 | 18.5 | 22.2 | 23.8 |
| Medium elongation [ME] (%) | 7.2 | 7.3 | 7.3 | 7.3 | 7.4 | 7.1 | 7.0 | 6.9 | 8.9 | 10.0 |
| Tenacity retention ratio (%) | 89.4 | 90.1 | 89.7 | 90.6 | 93.6 | 88.6 | 83.7 | 89.6 | 91.7 | 93.8 |
| Properties of treated cord | | | | | | | | | | |
| Fineness (Denier) | 2218 | 2217 | 2215 | 2216 | 2219 | 2220 | 2229 | 2215 | 2227 | 2235 |
| Strength (kg) | 15.61 | 15.79 | 15.75 | 15.80 | 15.73 | 15.72 | 14.98 | 15.42 | 16.01 | 16.23 |
| Tenacity (g/d) | 7.04 | 7.12 | 7.11 | 7.13 | 7.09 | 7.08 | 6.72 | 6.96 | 7.19 | 7.26 |
| Elongation at break (%) | 13.0 | 13.4 | 13.5 | 13.6 | 14.6 | 13.1 | 12.5 | 12.2 | 14.2 | 14.5 |
| Medium elongation (%) | 3.5 | 3.6 | 3.5 | 3.4 | 3.5 | 3.5 | 3.5 | 3.5 | 3.5 | 3.5 |
| Dry hot shrinkage at 177° C. [ΔS] (%) | 4.5 | 4.8 | 4.4 | 4.5 | 4.3 | 4.4 | 4.4 | 4.5 | 4.2 | 4.2 |
| Dimensional stability index [Y] (%) | 8.0 | 8.4 | 7.9 | 7.9 | 7.8 | 7.9 | 7.9 | 8.0 | 7.7 | 7.7 |
| Tenacity retention ratio (%) | 95.9 | 96.5 | 96.6 | 96.0 | 97.0 | 93.6 | 92.0 | 94.4 | 97.1 | 98.1 |
| In-rubber heat resistance (%) | 70 | 73 | 72 | 72 | 68 | 74 | 75 | 72 | 68 | 67 |
| Fatigue resistance (min) (GY fatigue life) | 292 | 301 | 305 | 310 | 367 | 265 | 227 | 281 | 275 | 259 |

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 | Comparative Example 11 |
|---|---|---|---|---|---|---|---|---|---|---|---|
| Properties of raw yarn | | | | | | | | | | | |
| Birefringence of undrawn yarn [Δn] × $10^{-3}$ | 38 | 38 | 28 | 57 | 36 | 56 | 20 | 39 | 24 | 42 | 44 |
| Intrinsic viscosity [IV] | 1.05 | 1.05 | 0.95 | 1.19 | 1.05 | 1.05 | 1.05 | 1.05 | 1.05 | 1.05 | 1.05 |
| Fineness (denier) | 1034 | 1032 | 1030 | 1032 | 1031 | 1029 | 1032 | 1030 | 1030 | 1032 | 1033 |
| Strength (kg) | 8.40 | 8.83 | 9.07 | 8.90 | 9.03 | 8.26 | 9.07 | 9.12 | 9.06 | 9.00 | 8.54 |
| Tenacity (g/d) | 8.12 | 8.56 | 8.81 | 8.62 | 8.76 | 8.03 | 8.79 | 8.85 | 8.80 | 8.72 | 8.27 |
| Elongation at break (%) | 12.1 | 12.1 | 11.6 | 11.6 | 12.7 | 10.7 | 14.6 | 12.4 | 14.3 | 11.6 | 11.2 |
| Product of tenacity × elongation (g/d · %) | 28.2 | 29.8 | 30.0 | 29.4 | 31.2 | 26.3 | 33.6 | 31.3 | 33.3 | 29.7 | 27.6 |
| Medium elongation (%) | 6.3 | 6.3 | 6.4 | 6.1 | 4.9 | 6.0 | 6.6 | 6.2 | 6.5 | 6.3 | 6.1 |
| Dry hot shrinkage (%) | 3.3 | 3.3 | 3.7 | 2.5 | 5.0 | 2.2 | 5.1 | 3.1 | 4.5 | 3.0 | 2.9 |
| Dimensional stability index (%) | 9.1 | 9.1 | 9.5 | 8.1 | 9.9 | 7.8 | 11.0 | 8.8 | 10.4 | 8.8 | 8.5 |
| Amorphous orientation function [fa] | 0.51 | 0.51 | 0.52 | 0.45 | 0.51 | 0.43 | 0.57 | 0.50 | 0.56 | 0.48 | 0.46 |
| Yarn-forming property | | | | | | | | | | | |
| Number of yarn breakage/ton | — | 7.2 | 0.8 | — | 5.8 | — | 0.9 | 5.3 | 1.2 | — | — |
| Number of single filament breakage/1,000 m | 26.0 | 17.0 | 0.7 | Many | 14.0 | Many | 0.7 | 10.5 | 0.9 | 12.0 | 21.0 |
| Properties of greige cord | | | | | | | | | | | |
| No. of twists in first twist (T/10 cm) | 50 | 50 | 50 | 50 | 50 | 50 | 50 | 50 | 50 | 50 | 50 |
| No. of twists in final twist (T/10 cm) | 50 | 50 | 50 | 50 | 50 | 50 | 50 | 50 | 50 | 50 | 50 |
| Twist coefficient in first twist | 2395 | 2395 | 2395 | 2395 | 2395 | 2395 | 2395 | 2395 | 2395 | 2395 | 2395 |
| Fineness (Denier) | 2295 | 2294 | 2296 | 2297 | 2296 | 2299 | 2297 | 2295 | 2296 | 2298 | 2294 |
| Strength (kg) | 14.64 | 15.30 | 15.57 | 15.92 | 16.05 | 14.85 | 16.38 | 16.11 | 16.37 | 15.47 | 15.16 |
| Tenacity (g/d) | 6.38 | 6.67 | 6.78 | 6.93 | 6.99 | 6.46 | 7.13 | 7.02 | 7.13 | 6.73 | 6.61 |
| Elongation at break (%) | 16.1 | 16.5 | 18.5 | 18.5 | 19.3 | 15.1 | 21.2 | 19.6 | 20.9 | 17.5 | 17.8 |
| Medium elongation [ME] (%) | 7.3 | 7.2 | 7.3 | 7.1 | 7.3 | 6.9 | 7.4 | 7.3 | 7.5 | 7.3 | 7.3 |
| Tenacity retention ratio (%) | 87.1 | 86.6 | 85.8 | 89.4 | 88.9 | 89.9 | 90.3 | 88.3 | 90.3 | 85.9 | 88.8 |
| Properties of treated cord | | | | | | | | | | | |
| Fineness (Denier) | 2214 | 2212 | 2211 | 2224 | 2213 | 2212 | 2223 | 2217 | 2215 | 2214 | 2212 |
| Strength (kg) | 14.26 | 14.71 | 14.79 | 15.23 | 15.31 | 14.58 | 14.73 | 15.47 | 14.75 | 14.76 | 14.60 |
| Tenacity (g/d) | 6.44 | 6.65 | 6.69 | 6.85 | 6.92 | 6.59 | 6.63 | 6.98 | 6.66 | 6.67 | 6.60 |
| Elongation at break (%) | 12.5 | 12.7 | 11.8 | 12.3 | 13.1 | 12.9 | 11.9 | 12.2 | 12.3 | 11.9 | 11.6 |
| Medium elongation (%) | 3.5 | 3.5 | 3.5 | 3.5 | 3.5 | 3.5 | 3.6 | 3.5 | 3.5 | 3.5 | 3.5 |
| Dry hot shrinkage at | 4.5 | 4.4 | 4.8 | 4.3 | 4.6 | 3.3 | 5.6 | 4.3 | 4.8 | 4.3 | 4.1 |

TABLE 2-continued

| | | | | | | | | | | | |
|---|---|---|---|---|---|---|---|---|---|---|---|
| 177° C. [ΔS] (%) | | | | | | | | | | | |
| Dimensional stability index [Y] (%) | 8.0 | 7.9 | 8.3 | 7.8 | 8.1 | 6.8 | 9.2 | 7.8 | 9.3 | 7.8 | 7.6 |
| Tenacity retention ratio (%) | 97.4 | 96.1 | 95.0 | 95.7 | 95.4 | 98.2 | 89.9 | 96.0 | 90.1 | 95.4 | 96.3 |
| In-rubber heat resistance (%) | 68 | 69 | 66 | 70 | 70 | 59 | 78 | 71 | 79 | 68 | 66 |
| Fatigue resistance (min) (GY fatigue life) | 210 | 277 | 225 | 276 | 283 | 250 | 178 | 286 | 172 | 242 | 227 |

| | Comparative Example 12 | Comparative Example 13 | Comparative Example 14 | Comparative Example 15 | Comparative Example 16 | Comparative Example 17 | Comparative Example 18 | Comparative Example 19 | Comparative Example 20 | Comparative Example 21 |
|---|---|---|---|---|---|---|---|---|---|---|
| Properties of raw yarn | | | | | | | | | | |
| Birefringence of undrawn yarn [Δn] × $10^{-3}$ | 22 | 63 | 38 | 38 | 38 | 38 | 38 | 38 | 38 | 32 |
| Intrinsic viscosity [IV] | 1.05 | 1.05 | 1.05 | 1.05 | 1.05 | 1.05 | 1.05 | 1.05 | 1.05 | 0.99 |
| Fineness (denier) | 1030 | 1030 | 1031 | 1030 | 1033 | 1031 | 1032 | 1020 | 1073 | 1010 |
| Strength (kg) | 9.05 | 9.04 | 8.89 | 8.90 | 9.13 | 8.12 | 9.88 | 9.36 | 7.97 | 8.28 |
| Tenacity (g/d) | 8.79 | 8.80 | 8.62 | 8.64 | 8.84 | 7.88 | 9.57 | 9.18 | 7.97 | 8.20 |
| Elongation at break (%) | 14.6 | 11.2 | 11.8 | 12.0 | 13.5 | 17.9 | 10.6 | 10.9 | 17.8 | 12.5 |
| Product of tenacity × elongation (g/d · %) | 33.6 | 29.3 | 29.6 | 29.9 | 32.4 | 33.3 | 31.2 | 30.3 | 33.6 | 29.0 |
| Medium elongation (%) | 6.6 | 6.0 | 6.3 | 6.3 | 6.3 | 6.5 | 5.8 | 4.8 | 10.6 | 5.1 |
| Dry hot shrinkage (%) | 5.1 | 2.2 | 3.2 | 3.4 | 3.2 | 3.1 | 3.6 | 5.2 | 2.0 | 4.6 |
| Dimensional stability index (%) | 11.0 | 7.8 | 9.0 | 9.2 | 9.0 | 9.0 | 9.1 | 10.1 | 10.0 | 9.7 |
| Amorphous orientation function [fa] | 0.57 | 0.42 | 0.51 | 0.51 | 0.51 | 0.50 | 0.51 | 0.51 | 0.48 | 0.50 |
| Yarn-forming property | | | | | | | | | | |
| Number of yarn breakage/ton | 1.2 | — | 3.2 | 6.2 | Many | 0.6 | 7.2 | 1.4 | Many | — |
| Number of single filament breakage/1,000 m | 0.9 | Many | 4.7 | 13.4 | — | 0.5 | 13.4 | 1.4 | — | — |
| Properties of greige cord | | | | | | | | | | |
| No. of twists in first twist (T/10 cm) | 50 | 50 | 50 | 50 | 50 | 50 | 50 | 50 | 50 | 50 |
| No. of twists in final twist (T/10 cm) | 50 | 50 | 50 | 50 | 50 | 50 | 50 | 50 | 50 | 50 |
| Twist coefficient in first twist | 2395 | 2395 | 2395 | 2395 | 2395 | 2327 | 2327 | 2327 | 2398 | 2329 |
| Fineness (Denier) | 2297 | 2296 | 2295 | 2294 | 2292 | 2255 | 2255 | 2259 | 2295 | 2260 |
| Strength (kg) | 16.35 | 15.75 | 15.51 | 16.08 | 16.32 | 14.70 | 16.10 | 16.04 | 16.33 | 14.70 |
| Tenacity (g/d) | 7.12 | 6.86 | 6.76 | 7.01 | 7.13 | 6.52 | 7.14 | 6.92 | 6.82 | 6.50 |
| Elongation at break (%) | 21.2 | 18.5 | 18.8 | 19.4 | 20.6 | 20.3 | 15.1 | 15.8 | 25.6 | 17.1 |
| Medium elongation [ME] (%) | 7.4 | 7.2 | 7.3 | 7.3 | 7.3 | 6.4 | 5.9 | 6.0 | 11.3 | 6.3 |
| Tenacity retention ratio (%) | 90.6 | 87.1 | 87.2 | 90.3 | 89.4 | 90.5 | 81.5 | 85.7 | 95.5 | 88.1 |
| Properties of treated cord | | | | | | | | | | |
| Fineness (Denier) | 2223 | 2218 | 2216 | 2215 | 2213 | 2224 | 2234 | 2233 | 2238 | 2242 |
| Strength (kg) | 14.18 | 14.90 | 14.83 | 15.51 | 15.78 | 14.63 | 14.44 | 14.96 | 15.84 | 14.66 |
| Tenacity (g/d) | 6.66 | 6.72 | 6.69 | 7.00 | 7.13 | 6.58 | 6.69 | 6.70 | 7.15 | 6.54 |
| Elongation at break (%) | 11.9 | 12.0 | 11.8 | 12.0 | 13.7 | 16.0 | 11.8 | 11.9 | 13.9 | 13.4 |
| Medium elongation (%) | 3.6 | 3.5 | 3.5 | 3.5 | 3.5 | 3.5 | 3.5 | 3.5 | 3.5 | 3.5 |
| Dry hot shrinkage at 177° C. [ΔS] (%) | 5.4 | 3.4 | 4.4 | 4.4 | 4.4 | 4.3 | 4.6 | 4.6 | 4.0 | 4.5 |
| Dimensional stability index [Y] (%) | 9.0 | 6.9 | 7.9 | 7.9 | 7.9 | 7.8 | 8.1 | 8.1 | 7.5 | 8.0 |
| Tenacity retention ratio (%) | 89.9 | 94.6 | 95.6 | 96.5 | 96.7 | 99.5 | 92.8 | 93.3 | 97.0 | 99.7 |
| In-rubber heat resistance (%) | 76 | 60 | 70 | 72 | 72 | 64 | 75 | 72 | 63 | 66 |
| Fatigue resistance (min) (GY fatigue life) | 195 | 255 | 247 | 302 | 309 | 273 | 193 | 215 | 198 | 250 |

COMPARATIVE EXAMPLE 22

A greige cord was prepared by using the raw yarn having properties shown in Run No. 5 of Example 1 in Japanese Unexamined Patent Publication No. 58-115117 as the known polyester fiber, and the greige cord was treated under the same conditions as in Examples 1 through 21 and Comparative Examples 1 through 21. The obtained treated cord had a tenacity of 6.6 g/d, an elongation at break of 11.4%, a dimensional stability index of 8.85%, and a fatigue resistance in a rubber of about 160 minutes.

Namely, the tenacity of the treated cord was low and the dimensional stability index of the treated cord was poor, and thus, a treated cord having excellent treated cord properties as intended in the present invention was not obtained. It is considered that this is because among the yarn properties, the tenacity-elongation product is lower than that of the present invention.

COMPARATIVE EXAMPLE 23

A greige cord was prepared by using the raw yarn having yarn properties shown in Run No. 3 of Example 3 in Japanese Unexamined Patent Publication No. 53-58031, which had an elongation at break of 7.21% and a tenacity-elongation product of 24.2, as the known polyester fiber, and a treated cord was prepared by treating the greige cord in the same manner as in Examples 1 through 21 and Comparative Examples 1 through 21. The obtained treated cord had a tenacity of 5.6 g/d and a dimensional stability index of 6.8%.

Although the dimensional stability index of the treated cord was good, the tenacity of the treated cord was very low, and a treated cord having excellent properties as intended in the present invention could not be obtained. It is considered that this is because, among the raw yarn properties, the tenacity is high, but the elongation is much lower than the level specified in the present invention and the tenacity-elongation product is low.

COMPARATIVE EXAMPLE 24

A greige cord was prepared by using UY/DY raw yarn disclosed in Comparative Example 1 of Japanese Unexamined Patent Publication No. 57-154410, which had a medium elongation of 4.6%, a dimensional stability index of 14.3 and an amorphous orientation function of about 0.64, as the known polyester fiber, and a treated cord was prepared by treating the greige cord in the same manner as described in Examples 1 through 21 and Comparative Examples 1 through 21. The obtained treated cord had a tenacity of 6.54 g/d, a dry hot shrinkage of 7.6% and a dimensional stability index of about 12.0%. The fatigue resistance in a rubber was about 65 minutes. The dimensional stability index was too high, and the objects of the present invention could not be attained.

In the polyester fiber for industrial use according to the present invention, the reduction of the characteristics is very small when the polyester fiber is formed into a treated cord. The polyester fiber has an excellent tenacity, elongation at break, medium elongation, shrinkage and dimensional stability and the treated cord made therefrom has an excellent fatigue resistance and in-rubber heat resistance. Especially, a rubber reinforcer in which these excellent characteristics are well balanced can be provided according to the present invention. These effects are enhanced if the concentration of terminal COOH groups in the polyester fiber for industrial use is controlled to a level lower than 25 eq/ton.

We claim:

1. A polyester untwisted multifilament yarn for industrial use, characterized in that at least 90 mole % of total recurring units of the molecule chain are composed of polyethylene terephthalate, and the untwisted multifilament yarn simultaneously satisfies all of the following requirements (A), (B), (C) and (D):

(A) the intrinsic viscosity (IV) is 0.97 to 1.15;

(B) the amorphous orientation function (fa) is not larger than 0.55;

(C) the tenacity (T) (g/d), the shrinkage ($\Delta s$) (%) as measured after standing in dry air at 150° C. for 30 minutes, the medium elongation (ME) (%) under a load of 4.5 g/d, and the dimensional stability index (Y) expressed by the formula: $Y = -ME^{0.81} + \Delta s = 1.32$ are within ranges defined by the following formulae (a), (b), (c), (d) and (e):

$$0.33Y + 5.55 \leqq T \leqq 0.33Y + 6.50 \quad \text{(a)},$$

$$8.0 \leqq T \leqq 9.5 \quad \text{(b)},$$

$$8.5 \leqq Y \leqq 10.5 \quad \text{(c)},$$

$$5 \leqq ME \leqq 10 \quad \text{(d)},$$

and $$2 \leqq s \leqq 6 \quad \text{(e); and}$$

(D) the elongation at break is at least 11% and the product of the tenacity and elongation, which is defined by:

$$(\text{tenacity } (g/d) \text{ at break}) \times \sqrt{\text{elongation } (\%) \text{ at break}},$$

is 30 to 36.

2. A polyester fiber for industrial use as set forth in claim 1, wherein the shrinkage ($\Delta S$) in hot and dry hair at 150° C. for 30 minutes is in the range of $2 \leqq \Delta S \leqq 4.5$.

* * * * *

UNITED STATES PATENT AND TRADEMARK OFFICE

CERTIFICATE OF CORRECTION

PATENT NO. : 5,049,447

DATED : September 17, 1991

INVENTOR(S) : Takeshi Shindo et al

It is certified that error appears in the above-identified patent and that said Letters Patent is hereby corrected as shown below:

In the Abstract, line 20,
"$2 \leqq \Delta S \leqq g$" should be changed to --$2 \leqq \Delta S \leqq 6$--.

Column 28, line 43, "fiber" should be changed to --untwisted multifilament yarn--.

Signed and Sealed this

Thirtieth Day of March, 1993

*Attest:*

STEPHEN G. KUNIN

*Attesting Officer*

*Acting Commissioner of Patents and Trademarks*